US005755048A

United States Patent [19]

Lee

[11] Patent Number: 5,755,048

[45] Date of Patent: May 26, 1998

[54] PAVEMENT CUTTER

[76] Inventor: Tracy W. Lee, 70 Fuller Rd., Trumbull, Conn. 06611

[21] Appl. No.: 731,088

[22] Filed: Oct. 9, 1996

Related U.S. Application Data

[60] Provisional application No. 60/005,026, Oct. 10, 1995.

[51] Int. Cl.[6] ..... E02D 17/13; E01C 23/09

[52] U.S. Cl. ..... 37/403; 404/90; 172/719; 172/778

[58] Field of Search ..... 37/403, 452, 460, 37/903; 172/777, 778, 719; 299/36.1, 67; 404/90

[56] References Cited

U.S. PATENT DOCUMENTS

| | | | |
|---|---|---|---|
| 1,982,387 | 11/1934 | Heltzel | 404/90 X |
| 2,536,308 | 1/1951 | Peirce | 172/778 |
| 2,643,868 | 6/1953 | Covington | 404/90 X |
| 3,297,364 | 1/1967 | McPherson | 299/36.1 |
| 3,885,833 | 5/1975 | Lemieux | 37/403 X |
| 4,043,601 | 8/1977 | Schiller | 299/36.1 |
| 4,515,408 | 5/1985 | Gurries | 404/90 X |
| 4,820,112 | 4/1989 | Mullican | 37/403 X |

*Primary Examiner*—Terry Lee Melius
*Assistant Examiner*—Robert Pezzuto
*Attorney, Agent, or Firm*—John R. Doherty

[57] ABSTRACT

A pavement cutter is provided for attachment to the boom assembly of a conventional backhoe or excavator including an elongated cutting blade having a scoring edge disposed in substantially parallel relation to the surface of the pavement and a cutting edge disposed substantially perpendicular to the scoring edge and wherein a pair of outwardly extending pressure flanges are attached to the blade one on each thereof at a point above the scoring and cutting edges of the blade. The pavement is first scored along a straight line using the scoring edge and then cut along the scored line using the cutting edge of the blade. The pressure flanges on each side of the cutting blade slide along the top surface of the pavement applying a vertical or downward force which prevents the asphalt from lifting and breaking up during the cutting operation.

6 Claims, 5 Drawing Sheets

PAVEMENT CUTTER

RELATED APPLICATIONS

This application claims priority to my earlier provisional application Ser. No. 60/005,026 entitled "Attachable Pavement Cutter for Buckets, Rippers or Booms of Earth Moving Machines such as a Backhoe or Excavator", filed on Oct. 10, 1995.

BACKGROUND OF THE INVENTION (1) Field of the Invention

This invention relates generally to pavement cutters and more particularly to an improved pavement cutter that can be easily and removable attached to a backhoe or excavator. In a specific aspect, the invention relates to a pavement cutter for attachment to the ripper or bucket in the boom of a backhoe or excavator.

(2) Description of the Prior Art

Asphalt pavements have been typically cut during excavation and repair operations using a hydraulic jack-hammer or a rotary saw blade. The jack-hammer is a relatively slow and arduous tool to use while the rotary saw blade is expensive and difficult to maintain.

Various attempts have been made in the past to incorporate a cutting blade within a backhoe or excavator. However, these attempts have not proven successful for one reason or another. For example, U.S. Pat. No. 3,885,833 issued to P. C. Lemieux on May 27, 1975 discloses a blacktop cutter which is attached to the leading edge of a bucket in a hydraulically operated front end loader. The problem with this structure is that the operator is seated on the loader behind the bucket and is unable to view the cutter or the work area. Consequently, this arrangement requires a second workman at the site to guide the operator during the cutting procedure.

U.S. Pat. No. 3,297,364 issued to A. W. McPherson on Jan. 10, 1967 discloses a tooth attachment for a backhoe boom having converging cutting edges. This type of cutting blade unfortunately tends to rip the asphalt as the blade travels across the pavement leaving behind a very uneven and jagged cut.

SUMMARY OF THE INVENTION

The invention is directed to a pavement cutter for cutting an asphalt pavement or the like using the conventional boom assembly pivotably attached to a backhoe, excavator or other earth moving machine. The pavement cutter of the invention comprises an elongated cutting blade having an upper body portion provided with means for removable attaching the blade to a boom assembly. The lower body portion of the blade has a scoring edge which is disposed in substantially parallel relation to the surface of the pavement which is to be cut. The lower body portion of the blade also includes a cutting edge which is disposed substantially perpendicular to the scoring edge and also to the surface of the pavement. A pair of outwardly extending pressure flanges are attached to the blade one on each side thereof at a point mid-way between the upper and lower body portions of the blade. The pressure flanges are positioned substantially equi-distant from the scoring edge with the cutting edge extending longitudinally along the blade from the scoring edge to the pair of pressure flanges.

In a preferred embodiment of the invention, the cutter blade is removable attached to a ripper or bucket employed at the outer end of the boom assembly. A sleeve or receptacle is formed within the upper body portion of the blade to receive the ripper tooth or one of the teeth on the leading edge of a bucket. A locking pin is removable inserted through the sleeve and the ripper or bucket tooth to complete the attachment.

The boom assembly typically includes a hydraulically operated main boom pivotably attached at one end to the backhoe or excavator and a hydraulically operated dipper pivotably attached to the other end of the main boom. A hydraulically operated ripper or bucket is in turn pivotably mounted to the outer end of the dipper and carries the cutter blade of the invention.

In operation, the boom assembly is pivoted outwardly beyond the backhoe or excavator a sufficient distance to place the scoring edge of the cutting blade at the point on the surface of the asphalt pavement where the cut is to begin. The main boom and the dipper are then pivoted about their respective pivot points causing the scoring edge to contact and partially cut through the asphalt and to score a line along the pavement. The blade is then repositioned at the beginning of the cut and pushed through the asphalt until the pair of pressure flanges rest on top of the pavement surface. The main boom and dipper are again pivoted together about their pivot points causing the cutting edge of the blade to cut the asphalt along the scored line formed by the cutting blade. The pressure flanges on each side of the cutting blade slide along the top surface of the pavement applying a vertical or downward force which prevents the asphalt from lifting and breaking up as the blade travels across the pavement. The flanges also aid in guiding the blade in the vertical direction during the cutting operation.

In a preferred embodiment of the invention, the pair of pressure flanges are curved or rounded which helps to prevent the edge of each flange from digging into the asphalt as the blade completes its travel through the pavement.

BRIEF DESCRIPTION OF THE DRAWING

The invention will now be described in greater detail with particular reference to the accompanying drawing wherein.

DESCRIPTION OF THE PREFERRED EMBODIMENTS

Figure 1:
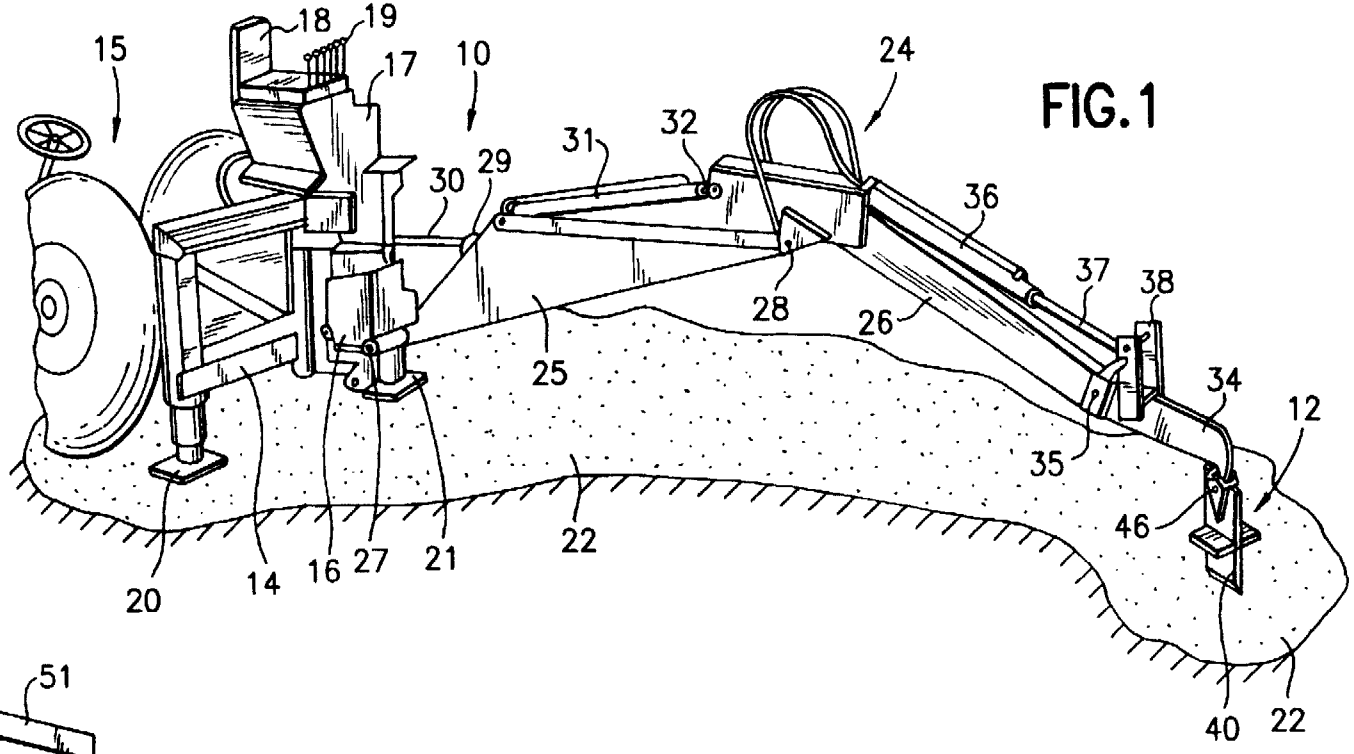
FIG. 1 is a perspective view of a backhoe including a boom assembly equipped with a pavement cutter according to the invention.
Figure 2:
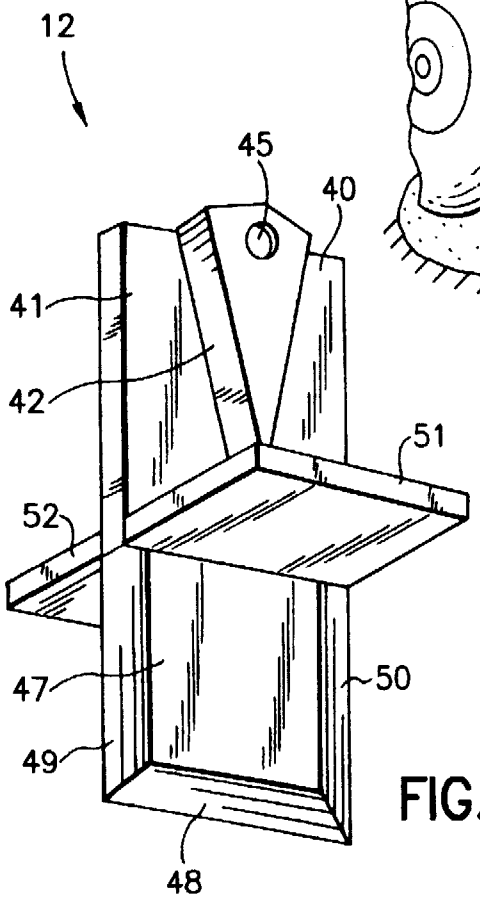
FIG. 2 is an enlarged perspective view of the pavement cutter employed in the backhoe and boom assembly shown in FIG. 1.
Figure 3:
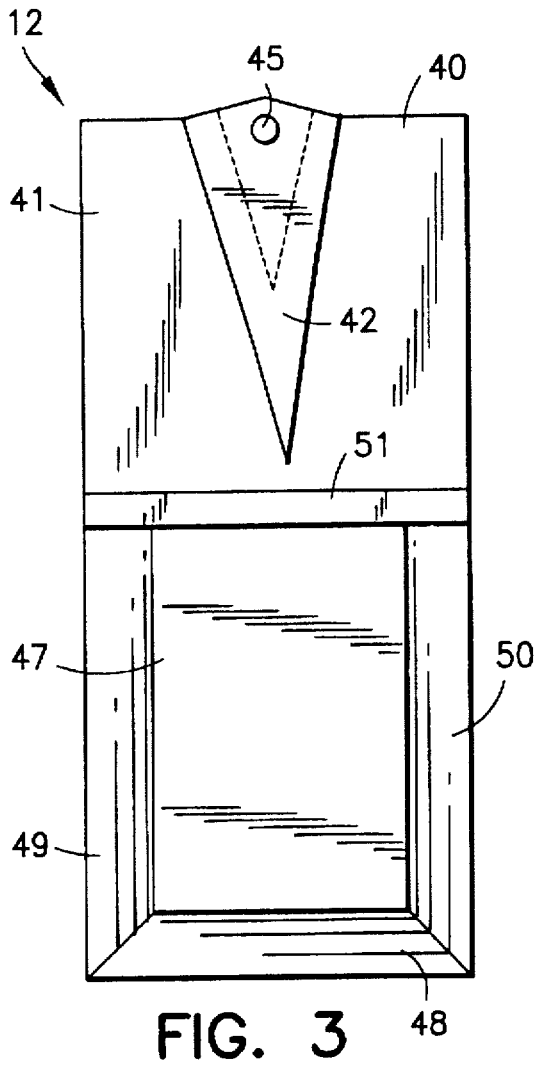
FIG. 3 is an enlarged side elevational view of the pavement cutter shown in FIG. 2.

Referring now to the drawing and particularly to FIGS. 1 and 2 thereof, there is shown a backhoe 10 equipped with a pavement cutter 12 according to the invention. For the sake of conciseness, the invention will be described herein with particular reference to a backhoe 10 employing a ripper but it will nevertheless be understood that the invention is not so limited and is equally applicable as well to a backhoe employing a bucket as shall be pointed out in more detail hereinafter.

The backhoe 10 includes a rectangular frame 14 which is mounted to the rear of a conventional tractor 15. A housing 16 is mounted to the center portion of the frame 14 and supports an operator's station 17 including a seat 18 and operating handles 19. A pair of flat shoes 20, 21 extend from opposite sides of the frame 14 and rest on the ground or pavement 22. The shoes are adjustable for stabilizing the backhoe 10 during its operation.

The backhoe 10 includes a boom assembly 24 comprising a main boom 25 and a dipper 26. The main boom 25 is pivotally attached to the housing 16 by a pivot pin 27 positioned just below the operator's station 17. The dipper 26 is pivotally attached to the outer end of the main boom 25 also by a pivot pin 28. A hydraulic cylinder 29 having a piston rod 30 is provided to effect rotation of the main boom 25 about the pivot pin 27. Similarly, a hydraulic cylinder 31 having a piston rod 32 is provided to effect rotation of the dipper 26 about the pivot pin 28. Movement of the boom assembly 24 horizontally across the surface of the pavement 22 is effected by a suitable drive mechanism (not shown) which is incorporated in the housing 16.

A ripper 34 is pivotally attached to the outer end of the dipper 26 by a pivot pin 35. A hydraulic cylinder 36 having a piston rod 37 is mounted to the dipper 26 to similarly effect rotation of the ripper 34. The piston rod 37 in this case is attached to a bracket 38 which rotates the ripper 34 about the pivot pin 35 when the cylinder 36 is actuated.

The ripper 34 is of a conventional design having a rounded outer end which is gradually tapered downwardly in the shape of a pointed tooth. The ripper tooth is commonly employed to break up asphalt pavements or to remove large rocks, tree stumps and the like at an excavation site, for example. In the present case, the ripper is used for attaching and operating the pavement cutter 12 according to the invention.

Figure 4:
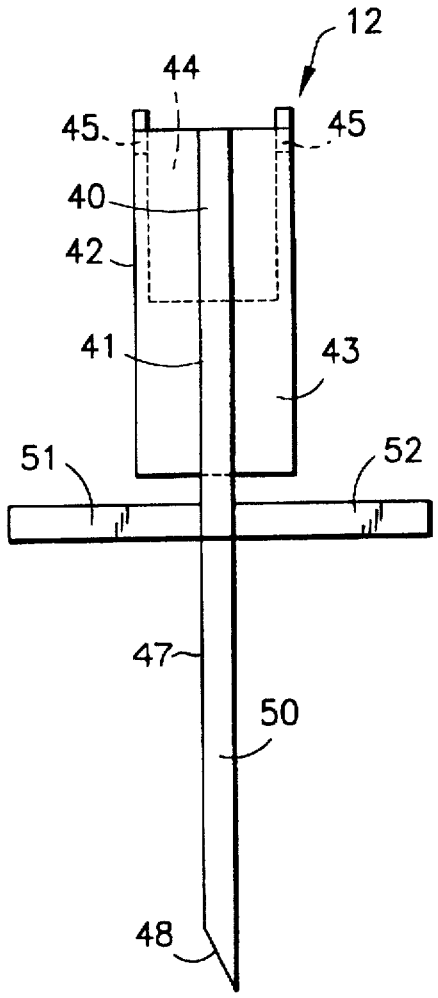
FIG. 4 is an enlarged frontal view of the pavement cutter.
Figure 5:
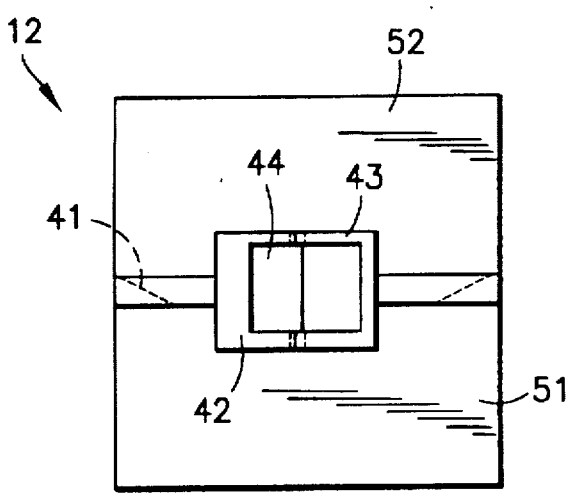
FIG. 5 is a top view of the pavement cutter shown in FIGS. 3 and 4.

As best seen in FIGS. 2–5, the pavement cutter 12 comprises a relatively thin, elongated, flat, rectangularly shaped cutter blade 40 suitably made from a hardened steel plate, for example. The cutter blade 40 has an upper body portion 41 which is cut in a V-shape and provided on each side with one of a pair of tapered end caps or sleeves 42, 43, forming a V-shaped cavity or receptacle 44 (FIG. 4). This cavity or receptacle is made of such a size and shape as to snugly receive the lower, pointed tooth section of the ripper 34. A hole 45 is provided within each of the caps or sleeves 42, 43 and a locking pin 46 (FIG. 1) is inserted through both holes and the tooth section for removable securing the cutter blade 40 to the ripper 34.

The cutter blade 40 has a lower body portion 47 which is provided with a straight bevelled scoring edge 48. This scoring edge is disposed in substantially parallel relation to the surface of the asphalt pavement 22 when the blade is attached to the ripper 34. The lower body portion of the blade is also provided with a pair of straight bevelled cutting edges 49, 50, one on each opposite longitudinal edge of the blade. These cutting edges are disposed substantially perpendicular to the scoring edge 48 and the surface of the asphalt pavement 22.

A pair of outwardly extending pressure flanges 51, 52 are attached one to each side of the cutting blade 40. The pressure flanges 51, 52 are rectangular in shape (FIG. 5) and are secured to the blade as by welding at a point substantially mid-way between the upper and lower body portions 41, 47. Each of the pressure flanges 51, 52 are positioned substantially equi-distant from the scoring edge 48. The pair of cutting edges 49, 50 extending longitudinally along the entire length of the lower body portion 47 of the blade from the scoring edge 48 to the pair of pressure flanges 51, 52.

Figure 6:
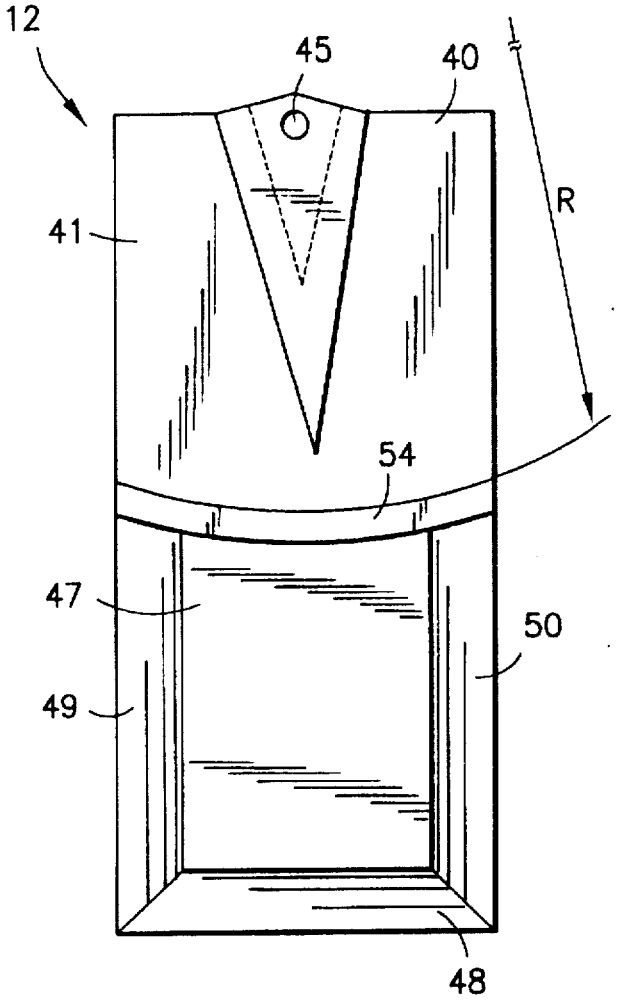
FIG. 6 is a view similar to FIG. 3 showing another embodiment of the invention.
Figure 7:
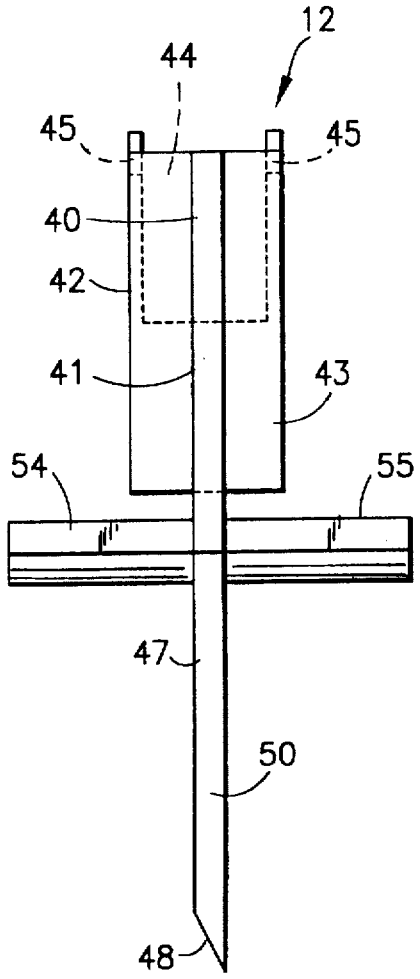
FIG. 7 is an enlarged frontal view of the pavement cutter shown in FIG. 6.

FIGS. 6 and 7 show a modified version of the pavement cutter 12 wherein a pair of rounded or curved pressure flanges 54, 55 are attached to the opposite sides of the cutting blade 40. As shall become more apparent hereinafter, these curved flanges tend to slide more easily over the pavement surface without digging into the asphalt.

Figure 8:
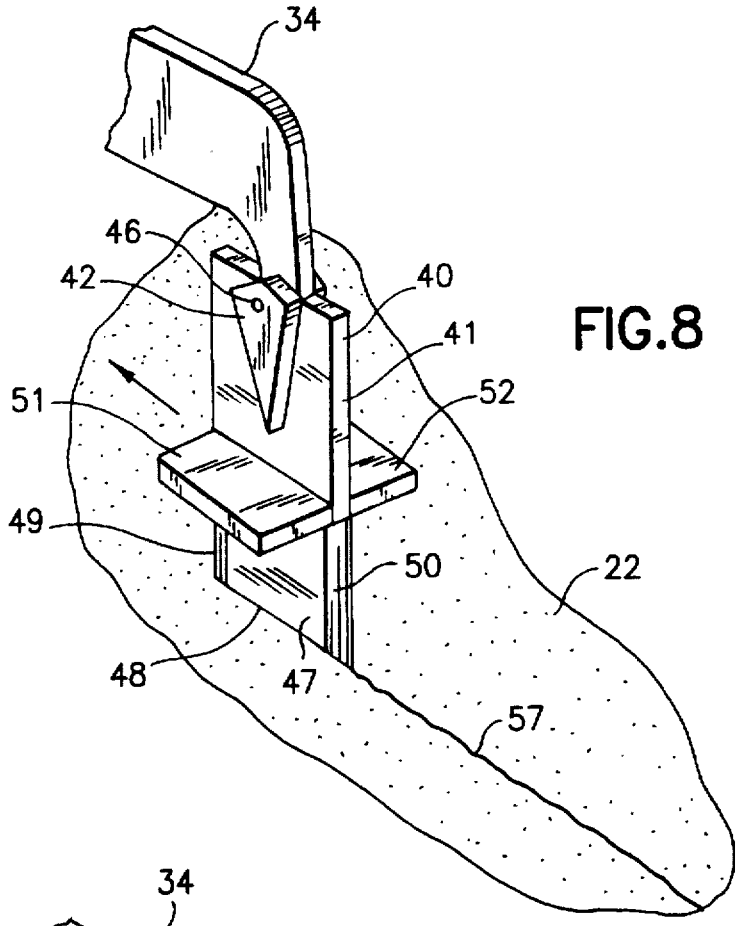
FIG. 8 is a perspective view showing the pavement cutter as it appears during the scoring operation.
Figure 9:
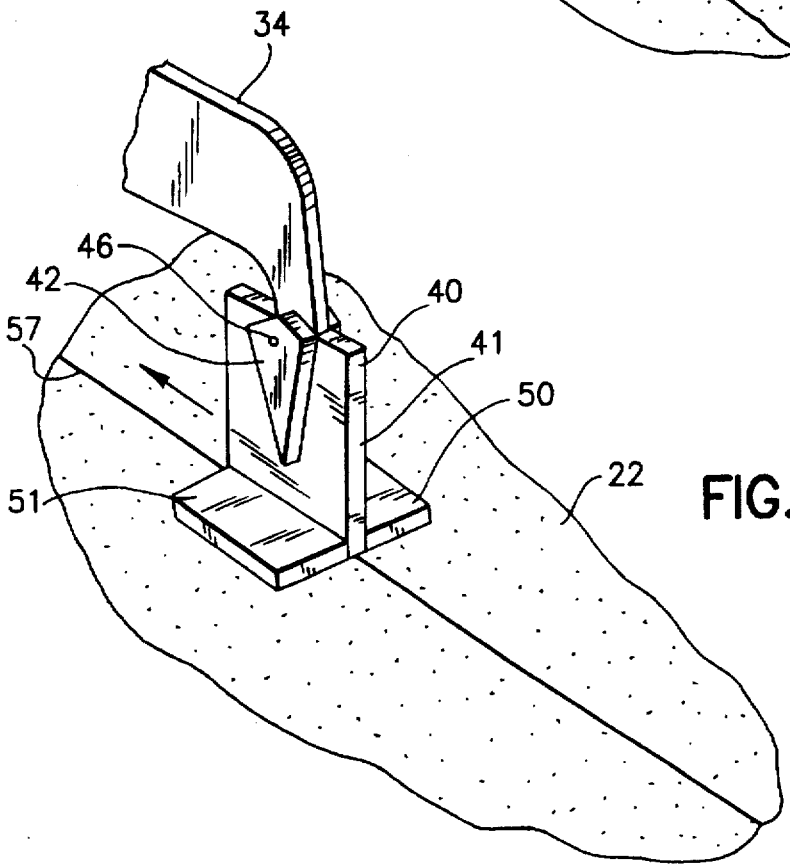
FIG. 9 is a similar view showing the pavement cutter as it appears during the cutting operation with the pressure flanges sliding along the top surface of the pavement.

The operation of the pavement cutter 12 according to the invention will now be described in detail with particular reference to FIGS. 1, 8 and 9 of the drawing. The operator is seated at the station 17 in the seat 18 just behind the operating handles 19. Using the handles 19, the operator extends the boom assembly 24 outwardly away from the backhoe frame 14 with the dipper 26 rotating about the pivot pin 28 until the cutting blade 40, pivotally attached to the ripper 34, is placed just above the point on the pavement 22 where the cut is to begin. The blade is then lowered until the scoring edge 48 rests on the pavement causing the asphalt surface to be indented under the combined weight of the boom 25, the dipper 26, the ripper 34 and the blade itself. The hydraulic cylinder 31 is then actuated causing the dipper 26 to rotate about the pivot pin 28 and the hydraulic cylinder 29 is actuated causing the main boom 25 to rotate about the pivot pin 27. This action by the cylinders in turn causes the blade 40 to move longitudinally back toward the frame 14 and across the pavement 22, scoring the asphalt surface along a substantially straight line as depicted at 57 in FIG. 8. The hydraulic cylinder 36 may be actuated to cause the ripper 34 to rotate about the pivot 35 and to adjust the vertical position of the blade 40. Once the score line 57 has been established, the boom assembly 24 is again extended by the operator to place the blade 40 back at the beginning point of the cut. The hydraulic cylinder 31 is then actuated to effect rotation of the dipper 26 about its pivot pin 28 causing the blade 40 to plunge through the asphalt at the beginning of the score line 57. This action causes the cutting edge 49 on the left side of the blade (FIG. 3) to align with the score line 57 and also places the pressure flanges 51, 52 in direct contact with the top surface of the pavement 22. The hydraulic cylinders 31 and 29 are again actuated causing the main boom 25 and the dipper 26 to rotate and move the blade 40 longitudinally back along the pavement 22, severing the scored and weakened asphalt along the score line 57 as depicted in FIG. 9. It will be seen that as the cutting blade 40 travels across the surface of the pavement 22, the pair of pressure flanges 51, 52 on each side of the blade slide along the top surface of the pavement, applying a vertical or downward force under the weight of the boom assembly. This vertical force prevents the asphalt from lifting and breaking up during the cutting operation. Thus, a continuous, smooth and straight cut through the asphalt pavement is possible. The pavement surface may be scored several or more times along the same score line if necessary prior to the cutting operation.

During the above described cutting operation, the blade 40 actually travels in an arc across the pavement surface due to the rotating action of the main boom 25 and the dipper 26, pivoting about the pivot pins 27 and 28. In some cases, this rotating action can cause the leading edges of the pressure flanges 51, 52 to dig into the asphalt causing it to break away leaving a jagged edge behind. This problem can be effectively overcome by employing the modified version of the cutting blade shown in FIGS. 6 and 7. In this modification as described above, the pressure flanges 54, 55 are curved or rounded so that the leading edges of the flanges will always lie in a plane above the surface of the asphalt and will not dig or rip into the pavement.

Figure 10:
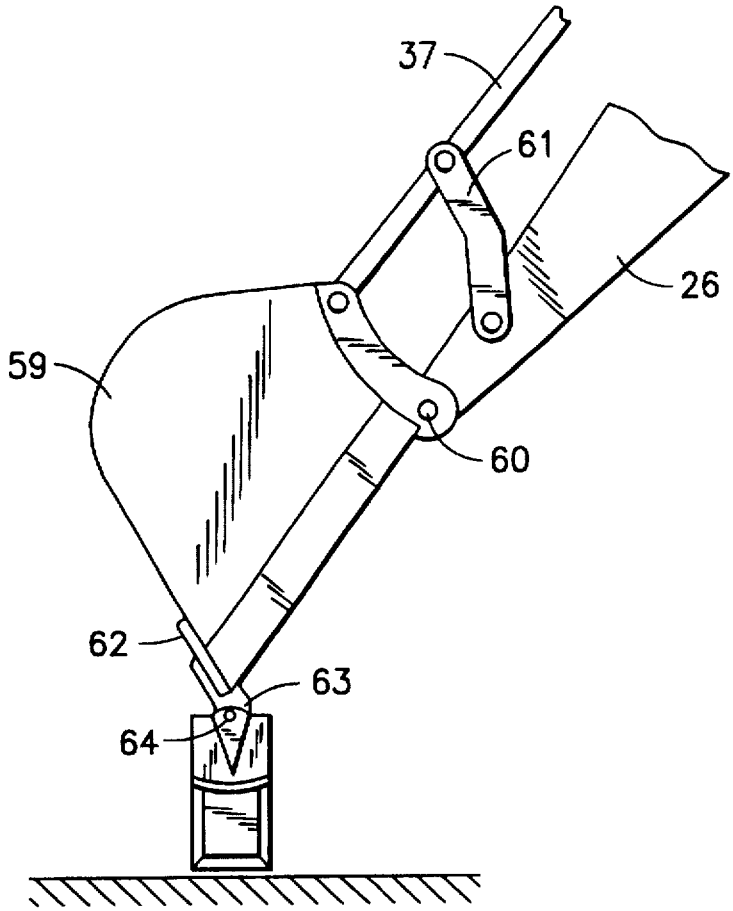
FIG. 10 is a side elevational view of a backhoe bucket having attached thereto a pavement cutter according to the invention.

FIG. 10 shows another embodiment of the pavement cutter of the invention wherein the blade 40 is attached to the bucket 59 of a backhoe instead of the ripper 34. The bucket 59 is pivotably attached to the end of the dipper 26 and rotates about the pivot pin 60 when the hydraulic cylinder 36 and its piston rod 37 are activated. A guide bracket 61 is also pivotably attached to both the rod 37 and the dipper 26.

The bucket 59 has provided along its lower leading edge 62 a plurality of teeth whose configuration is basically the same as the tooth portion of the ripper 34 described hereinabove. The blade 40 is attached to one of the these teeth in the same manner as described above. The tooth 63 is positioned inside the receptacle 4 (FIG. 44) formed at the upper body portion 41 of the blade and is held in place by a locking pin 64.

Operation of the pavement cutter is the same as described hereinabove in the case of the ripper 34. The scoring edge 48 of the blade scores the top surface of the asphalt pavement 22 and the cutting edge 49 severs the pavement along the score line 57 as shown in FIGS. 6 and 7. It should be noted that the blade 40 shown in FIG. 10 incorporates the curved or rounded pressure plates 54, 55 for a smooth cut through the pavement.

It should be noted that while most asphalt pavements are made with a thickness of two inches or more, there are instances where the asphalt is less than this thickness and depending upon the specific composition of the asphalt, the scoring step outlined above may not be suitable. However, the pavement cutter of the invention may still be advantageously used, in these instances, by employing the scoring edge rather as a cutting edge to effect a plunge cut through the asphalt. The same cutting procedure as outlined above may then be used to cut a straight line through the asphalt pavement.

In this connection, it is important to point out that the scoring edge 48 and each of the cutting edges 49, 50 form a sharp pointed corner (FIG. 2) which is ideally suited for piercing the asphalt when the blade is plunged through the pavement. To this end, it may be advantageous to tilt the blade slightly before plunging so as to better align the sharp corner with the asphalt surface.

It should be noted particularly from the views of FIGS. 6 and 7 that both the scoring and cutting edges of the blade 40 are straight bevel edges. The straight bevelled edges are preferred since they effect a smoother cut through the asphalt pavement and help to maintain the shape of the bevel edges during use.

Finally, it should be noted that while only one cutting edge on the blade 40 is used during the cutting procedure, the blade is preferably equipped with two cutting edges as at 49, 50. This feature allows either cutting edge to be used with the straight bevelled surface properly aligned for the smoothest cut possible. The alternative cutting edges can be easily used by removing and rotating the blade. For example, when removing asphalt pavement to dig a trench, it is possible to provide a clean and smooth cut on each side of the trench using the flat or unbevelled side of the blade by simply rotating the blade without changing the direction of the boom assembly. The cutting blade is symmetrical and will easily allow for this adaptation.

What is claimed is:

1. A pavement cutter for scoring and cutting an asphalt pavement using a boom having a tooth attached thereto, said pavement cutter comprising, in combination:

a substantial flat blade having a top, bottom and opposite sides and having an elongated scoring edge disposed at said bottom of said blade and an elongated cutting edge disposed substantially perpendicular to said scoring edge, said scoring edge and said cutting edge being defined by a substantially straight beveled surface extending from one to the other of said opposite sides of said blade;

a pair of pressure plates one of each of which is affixed to and extends outwardly from one of said opposite sides of said blade at a point between said top and bottom thereof, said pressure plates having a convex curved surface facing said scoring edge and being substantially equidistant from said scoring edge with said cutting edge extending along said blade substantially from said scoring edge to said pressure plates;

means forming a receptacle at the top of said blade for receiving said tooth, and means for removably securing said tooth within said receptacle.

2. Apparatus according to claim 1, wherein said blade has an elongated rectangular configuration and wherein a pair of said cutting edges are provided one on each opposite longitudinal edge of said blade.

3. Apparatus according to claim 2, wherein said scoring edge extends across the bottom of said blade between said pair of cutting edges.

4. An apparatus according to claim 3, wherein said scoring edge and said cutting edges intersect to form a sharp pointed corner at the bottom of said blade useful for plunge cutting said pavement.

5. A method of cutting an asphalt pavement comprising the steps of:

providing a cutting blade having a scoring edge disposed in substantially parallel relation to said pavement and a cutting edge disposed substantially perpendicular to said scoring edge and having a pair of pressure flanges affixed to and extending outwardly from said blade one on each side thereof at a point above said scoring and said cutting edge;

placing said blade over said pavement with said scoring edge in contact therewith;

moving said blade across said pavement so as to score a line therein to a depth sufficient to weaken said pavement;

raising said blade above said pavement;

positioning said blade over said score line with said cutting edge substantially aligned therewith;

plunging said blade through said pavement at said score line; and moving said blade along said score line with said pressure flanges in contact with said pavement on each side of said line.

6. Apparatus for scoring and cutting an asphalt pavement comprising, in combination:

a boom having a distal end;

a ripper pivotably mounted to said distal end, said ripper having a substantially V-shaped tooth;

an elongated blade having an upper body portion and a lower body portion and having substantially flat opposite sides, said lower body portion including an elongated scoring edge disposed in substantially parallel relation to said pavement and an elongated cutting edge disposed substantially perpendicular to said scoring edge, said scoring edge and said cutting edge being defined by a substantially straight beveled surface extending from one to the other of said opposite sides of said blade, a pair of pressure flanges one of each of which is affixed to and extends outwardly from one of said opposite sides of said blade at a point between said upper and lower body portions, said pressure plates having a convex curved surface facing said scoring edge and being substantially equidistant from said scoring edge with said cutting edge extending along said lower body portion substantially from said scoring edge to said pressure plates; and means for attaching said blade to said boom comprising a cut-away within said upper body portion of said blade and a sleeve overlying said cut-away on each of said opposite sides forming a substantially V-shaped receptacle for receiving said tooth, said sleeve and said tooth having a holes therein, and a locking pin mounted within said holes for removably securing said tooth within said receptacle.

* * * * *